US011132937B2

(12) United States Patent
Shin et al.

(10) Patent No.: US 11,132,937 B2
(45) Date of Patent: Sep. 28, 2021

(54) DISPLAY DRIVER WITH REDUCED POWER CONSUMPTION AND DISPLAY DEVICE INCLUDING THE SAME

(71) Applicant: Magnachip Semiconductor, Ltd., Cheongju-si (KR)

(72) Inventors: Seung Jo Shin, Cheongju-si (KR); Hyung Pil Kim, Cheongju-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 67 days.

(21) Appl. No.: 16/562,899

(22) Filed: Sep. 6, 2019

(65) Prior Publication Data

US 2020/0105186 A1 Apr. 2, 2020

(30) Foreign Application Priority Data

Sep. 27, 2018 (KR) ..... 10-2018-0114768

(51) Int. Cl.
*G09G 3/32* (2016.01)

(52) U.S. Cl.
CPC ..... *G09G 3/32* (2013.01); *G09G 2310/0291* (2013.01); *G09G 2310/0297* (2013.01); *G09G 2330/021* (2013.01); *G09G 2330/027* (2013.01)

(58) Field of Classification Search
CPC ..... G09G 3/32; G09G 3/36
See application file for complete search history.

(56) References Cited

U.S. PATENT DOCUMENTS

| | | | | |
|---|---|---|---|---|
| 8,144,100 | B2 | 3/2012 | Woo et al. | |
| 8,179,345 | B2 | 5/2012 | Woo et al. | |
| 9,905,167 | B2 | 2/2018 | Jeon et al. | |
| 2004/0263087 | A1* | 12/2004 | Maede | G09G 3/3283 315/169.3 |
| 2016/0133179 | A1* | 5/2016 | Choi | G09G 3/3688 345/212 |

* cited by examiner

*Primary Examiner* — Amare Mengistu
*Assistant Examiner* — Cory A Almeida
(74) *Attorney, Agent, or Firm* — NSIP Law

(57) ABSTRACT

A display driver for driving a display panel includes a first driving circuit configured to output a first image signal to a first output pad, and a second driving circuit configured to output a second image signal to a second output pad; and the first driving circuit is further configured to output a reference image signal to the second driving circuit in response to a power down signal, and the second driving circuit is further configured to output the reference image signal output from the first driving circuit to the second output pad in response to the power down signal.

23 Claims, 10 Drawing Sheets

[FIG. 1]
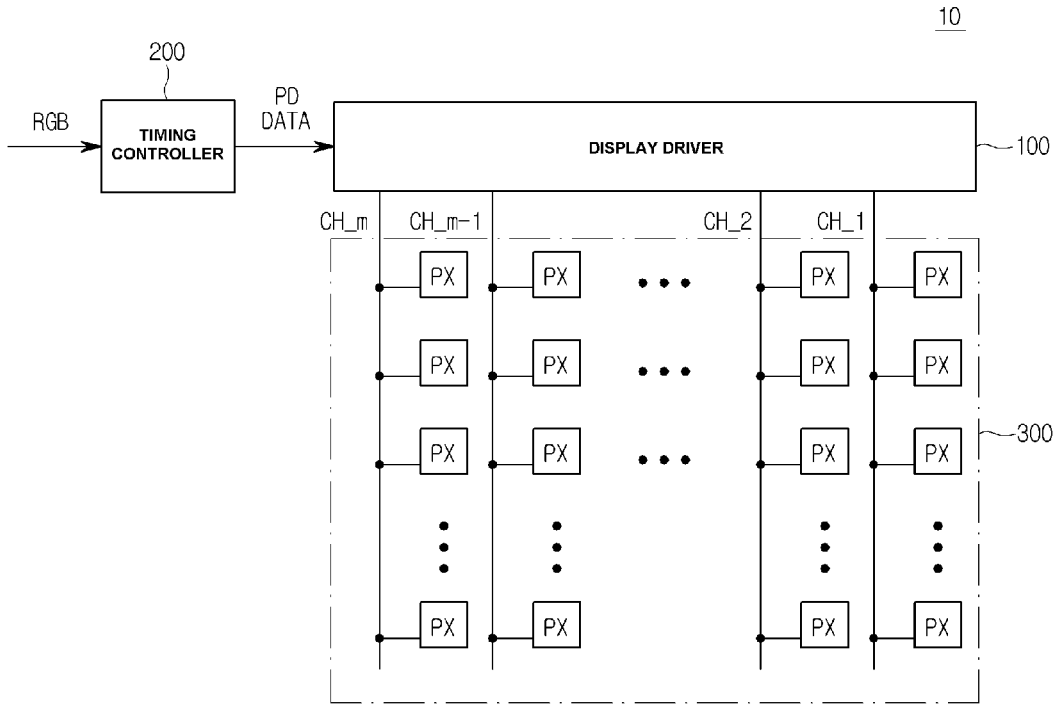

[FIG. 2]
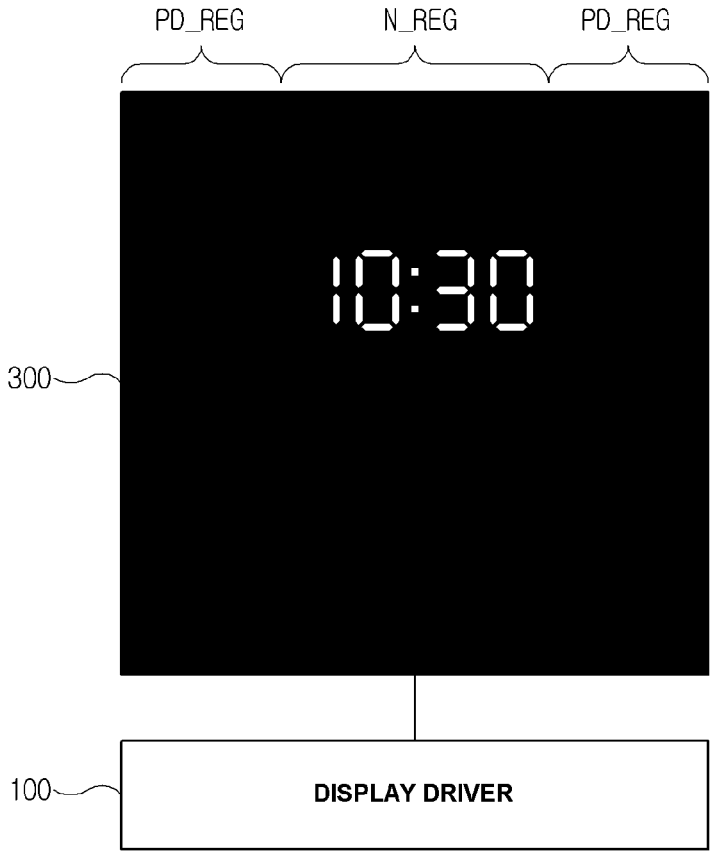

[FIG. 3]
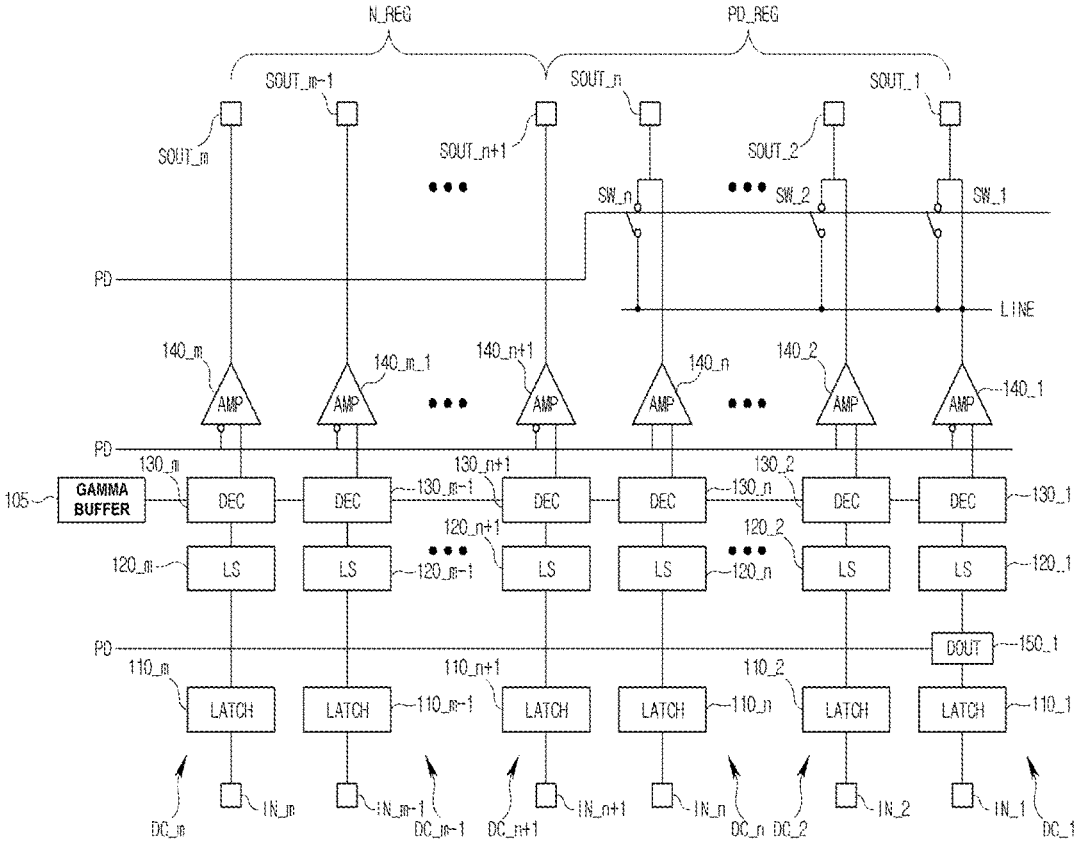

[FIG. 4]
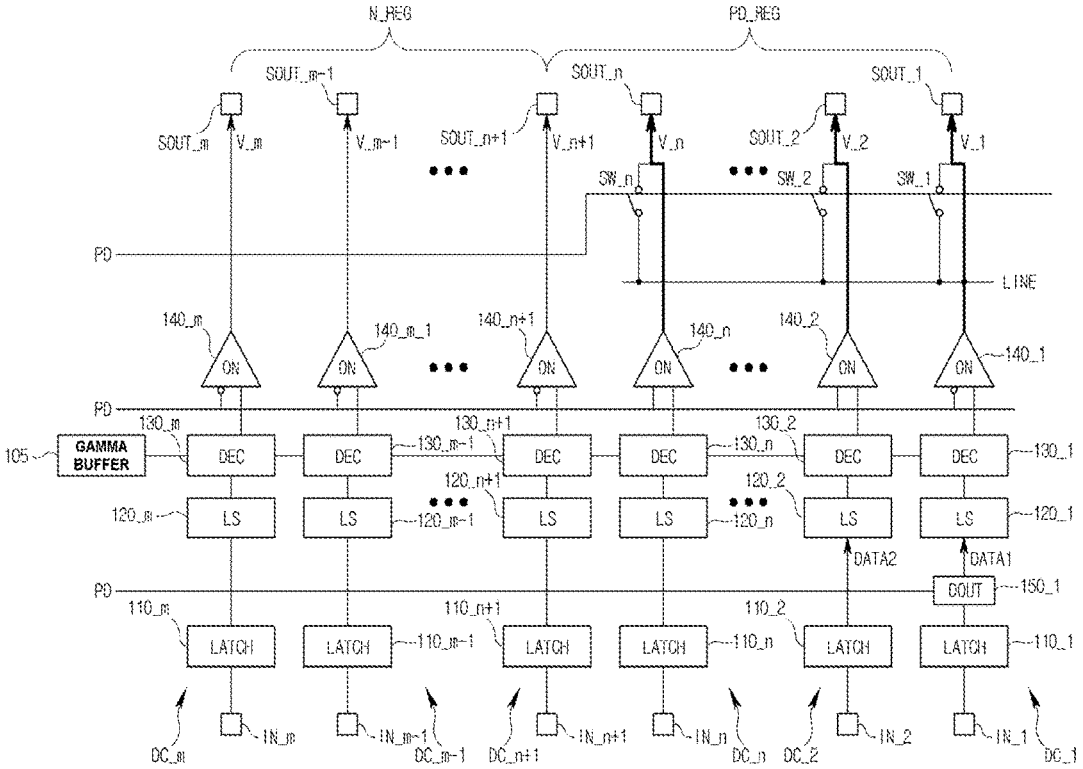

[FIG. 5]
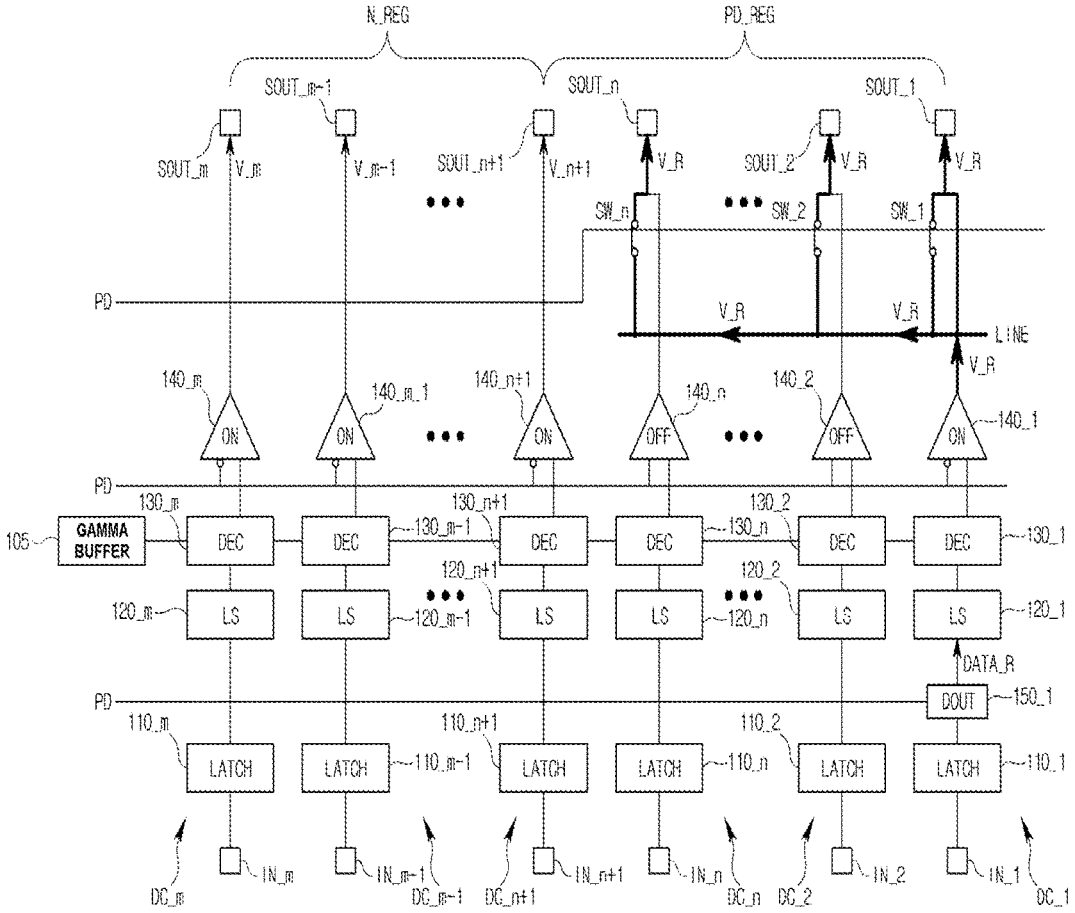

[FIG. 6]
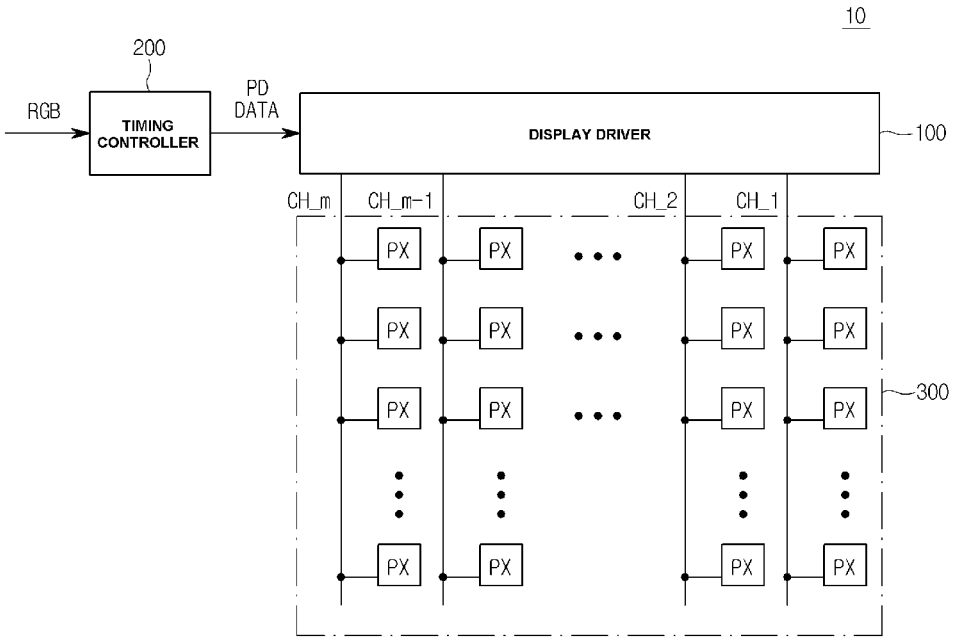

[FIG. 7]
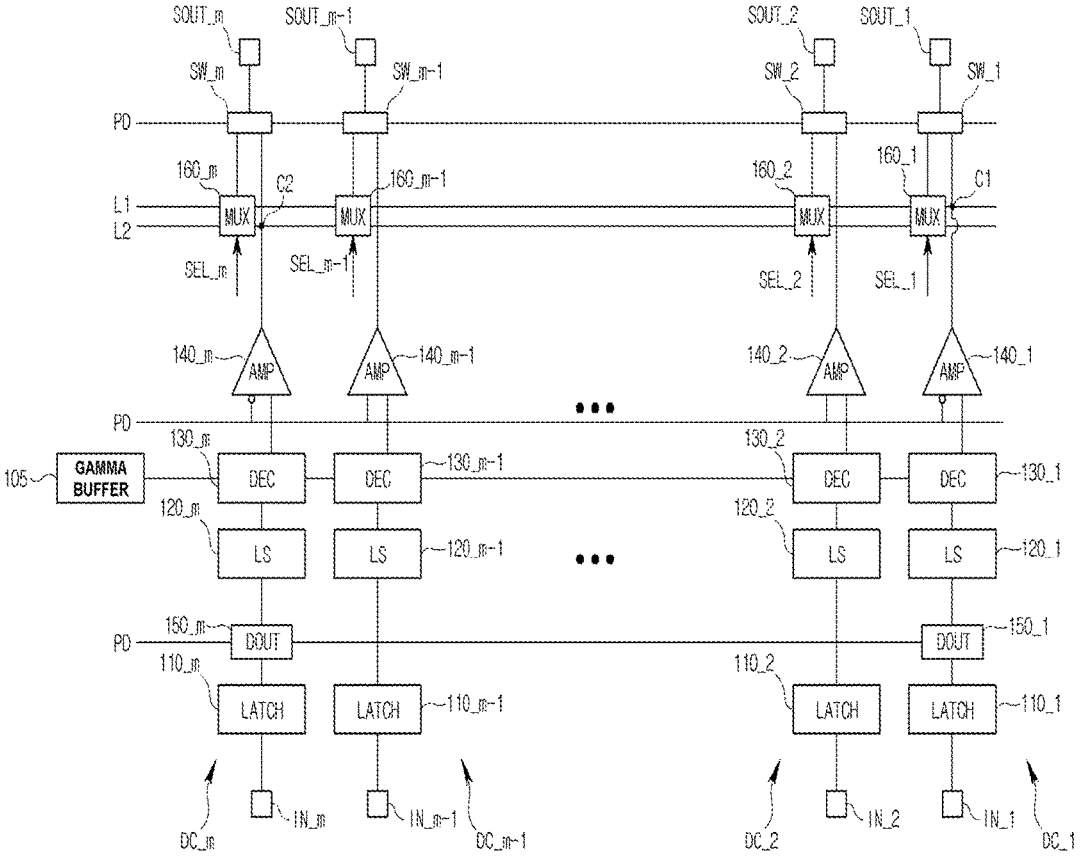

[FIG. 8]
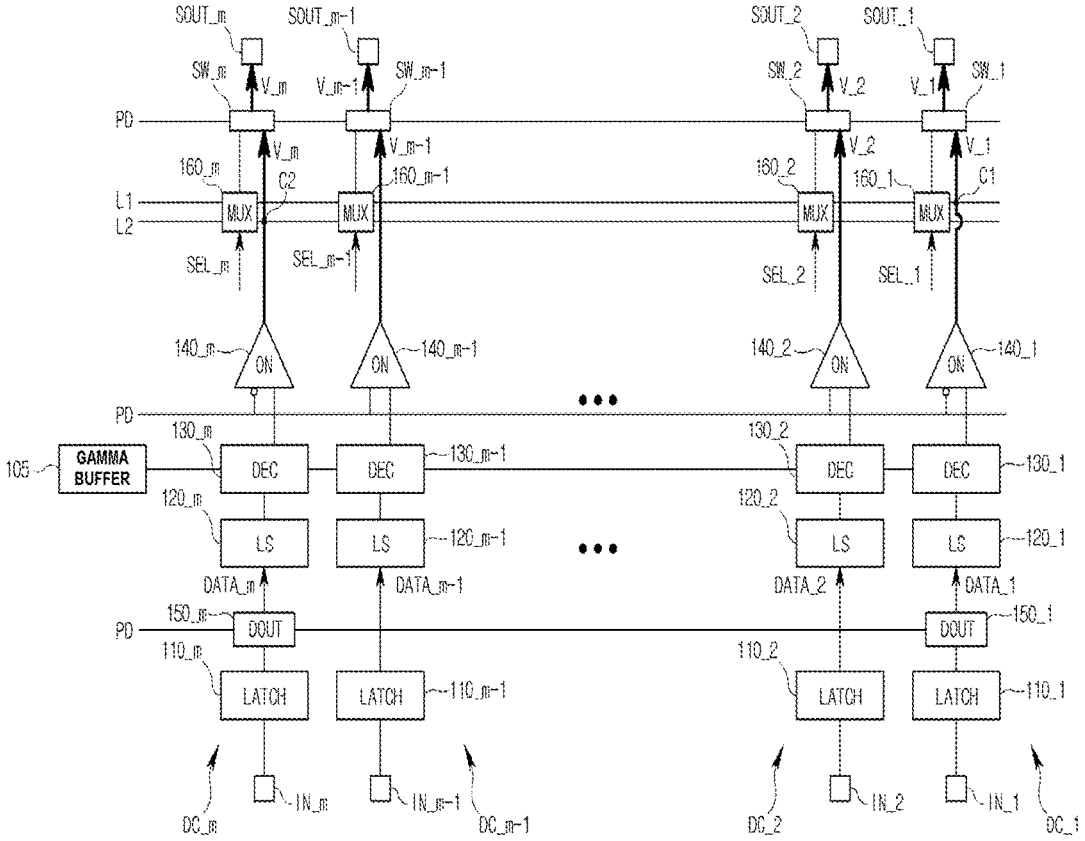

[FIG. 9]
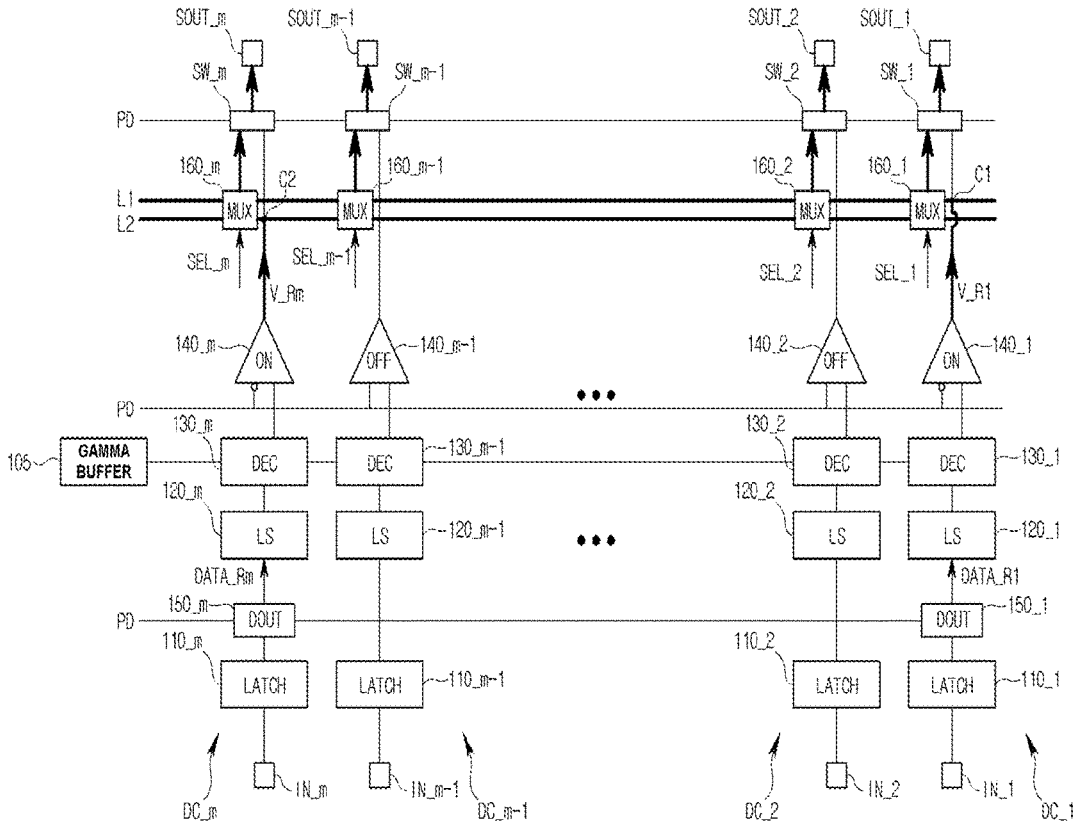

[FIG. 10]
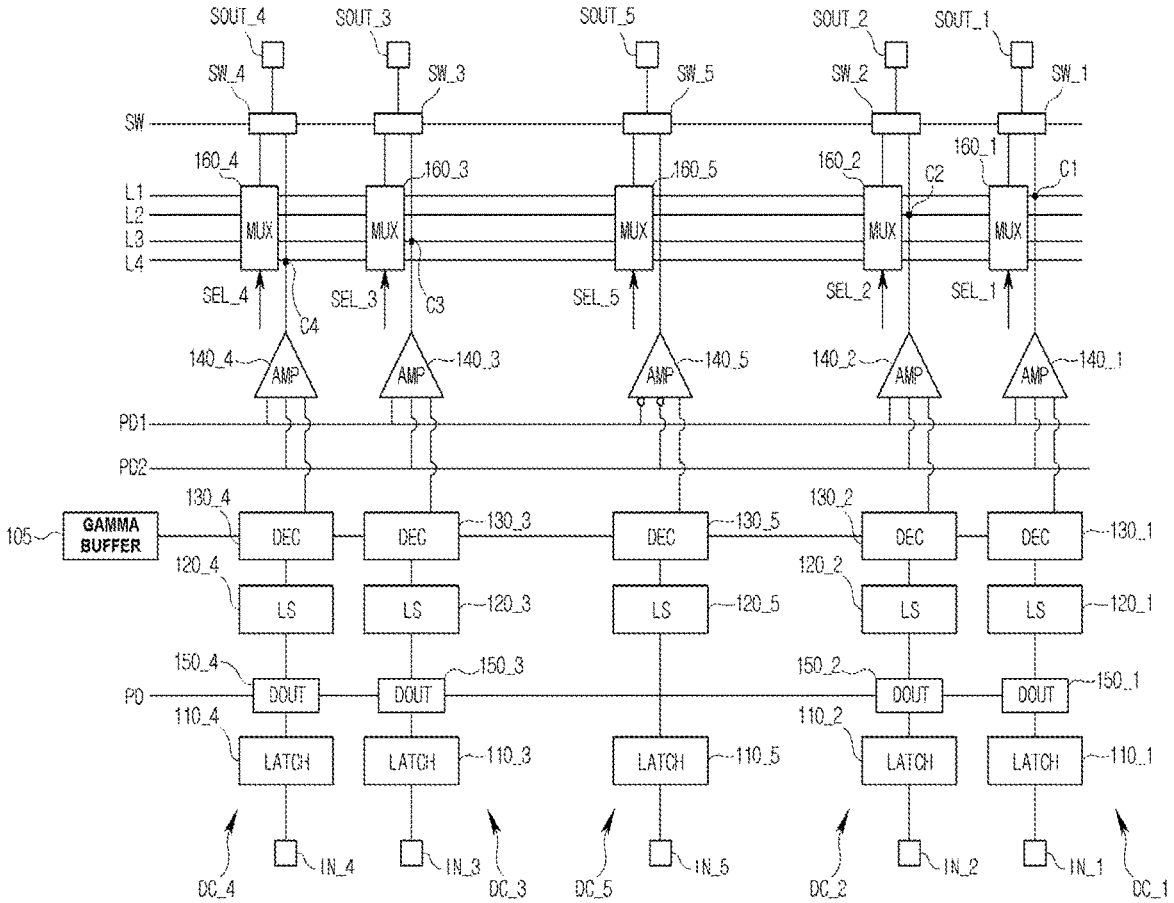

DISPLAY DRIVER WITH REDUCED POWER CONSUMPTION AND DISPLAY DEVICE INCLUDING THE SAME

CROSS-REFERENCE TO RELATED APPLICATION

This application claims the benefit under 35 USC § 119(a) to Korean Patent Application No. 10-2018-0114768, filed on Sep. 27, 2018, the entire disclosure of which is incorporated herein by reference for all purposes.

BACKGROUND

1. Field

The following description relates to a display driver with reduced power consumption. The following description also relates to a display device including the display driver.

2. Description of Related Art

As the number of pixels arranged in a display panel increases, the degree of integration of a display driver for driving the display panel increases, thus increasing power consumption of the display driver. Therefore, there is a need to reduce the power consumption of the display driver.

As examples of a low power mode, methods for turning off the unused portion(s) of the display panel, and methods for displaying images with a small number of colors (e.g., eight colors) have been implemented.

However, with regard to the methods for turning off unused portion(s) of the display panel, since the turned-off portion(s) of the display panel may be driven only by a power supply voltage, it may be difficult to variously express the color. Additionally, it may be difficult to implement the same color as the used portion. With regard to the method for displaying images with a small number of colors, since a reference voltage corresponding to the small number of colors may be received from a gamma buffer, the size of the entire display driver increases.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, a display device includes a first driving circuit configured to output a first image signal to a first output pad, and a second driving circuit configured to output a second image signal to a second output pad, wherein the first driving circuit is further configured to output a reference image signal to the second driving circuit in response to a power down signal, and wherein the second driving circuit is further configured to output the reference image signal output from the first driving circuit to the second output pad in response to the power down signal.

The second driving circuit may include a switch connected between the second output pad and the first driving circuit, and the switch may be configured to output the reference image signal output from the first driving circuit to the second output pad in response to the power down signal.

The first driving circuit may include a first amplifier configured to output one of the first image signal and the reference image signal, the second driving circuit may further include a second amplifier configured to output the second image signal, and the second amplifier may be further configured to be turned off in response to the power down signal.

The display driver may further include a signal line connected between the first driving circuit and the switch of the second driving circuit.

The first driving circuit may include a first latch configured to store first image data corresponding to the first image signal, and a data output unit configured to output one of the first image data output from the first latch and reference image data corresponding to the reference image signal, and the data output unit is further configured to output the reference image data instead of the first image data in response to the power down signal.

The data output unit may be implemented as a set of logic gates including at least one of an OR gate and a NOR gate.

The first image signal may be generated based on first image data input from a first input pad, the second image signal may be generated based on second image data input from a second input pad, and the reference image signal may be generated based on reference image data previously stored in the display driver.

In a general aspect, a display driver includes a first driving circuit connected to a first sub-pixel column among a plurality of sub-pixel columns, and a second driving circuit connected to a second sub-pixel column among the plurality of sub-pixel columns, wherein the first driving circuit may be configured to output a first image signal to the first sub-pixel column when the display driver operates in a first mode, and may be further configured to output a reference image signal to the second driving circuit when the display driver operates in a second mode, wherein the second driving circuit may be configured to output a second image signal to the second sub-pixel column when the display driver operates in the first mode, and may be further configured to output the reference image signal output from the first driving circuit to the second sub-pixel column when the display driver operates in the second mode, and wherein the power consumed by the display driver in the first mode is greater than the power consumed by the display driver in the second mode.

The display driver may be configured to operate in the second mode in response to a power down signal, wherein the first driving circuit may be further configured to output the reference image signal to the second driving circuit in response to the power down signal, and wherein the second driving circuit may be further configured to output the reference image signal output from the first driving circuit to the second sub-pixel column in response to the power down signal.

The first driving circuit may include a first amplifier configured to output one of the first image signal and the reference image signal, the second driving circuit may further include a second amplifier configured to output the second image signal, and the second amplifier may be further configured to be turned off in response to the power down signal.

The first driving circuit may include a first latch configured to store first image data corresponding to the first image signal, and a data output unit may be configured to output one of the first image data output from the first latch and reference image data corresponding to the reference image signal, and wherein the data output unit may be further configured to output the reference image data instead of the first image data in response to the power down signal.

The data output unit may be implemented as a set of logic gates comprising at least one of an OR gate and a NOR gate.

In a general aspect, a display driver includes a first driving circuit configured to output a first image signal corresponding to first image data to a first output pad, a second driving circuit configured to output a second image signal corresponding to second image data to a second output pad, and a third driving circuit configured to output a third image signal corresponding to third image data to a third output pad, wherein the first driving circuit may be further configured to output a first reference image signal corresponding to first reference image data to the second driving circuit and the third driving circuit in response to a power down signal, wherein the second driving circuit may be further configured to output a second reference image signal corresponding to second reference image data to the first driving circuit and the third driving circuit in response to the power down signal, and wherein the third driving circuit may be further configured to output any one of the first reference image signal and the second reference image signal in response to the power down signal.

The first driving circuit may include a first amplifier configured to output one of the first image signal and the first reference image signal, wherein the second driving circuit may include a second amplifier configured to output one of the second image signal and the second reference image signal, wherein the third driving circuit comprises a third amplifier configured to output the third image signal, and wherein the third amplifier is further configured to be turned off in response to the power down signal.

The third driving circuit may further include a multiplexer configured to select any one of the first reference image signal output from the first driving circuit and the second reference image signal output from the second driving circuit, and may be further configured to output the selected image signal, and wherein the multiplexer is further configured to perform the selecting based on a most significant bit (MSB) of the third image data.

The multiplexer may be connected to the first driving circuit through a first signal line and is connected to the second driving circuit through a second signal line, and wherein the third image signal output from the third driving circuit may not be transmitted to the multiplexer.

The first driving circuit may include a first latch configured to store the first image data, and a first data output unit configured to output one of the first image data output from the first latch and the stored first reference image data, wherein the second driving circuit may include a second latch configured to store the second image data, and a second data output unit configured to output one of the second image data output from the second latch and the stored second reference image data, wherein the first data output unit is further configured to output the first reference image data instead of the first image data in response to the power down signal, and wherein the second data output unit is further configured to output the second reference image data instead of the second image data in response to the power down signal.

The first data output unit and the second data output unit may be implemented as a set of logic gates comprising at least one of an OR gate and a NOR gate.

In a general aspect, a display device includes a display panel and a display driving device, the display device includes a plurality of driving circuits, wherein the display driving device is configured to operate in a normal mode and a power down mode, wherein, in the power down mode, a first amplifier of a first driving circuit of the plurality of driving circuits is turned on, and a second amplifier of a second driving circuit of the plurality of driving circuits is turned off, wherein, in the power down mode, the first driving circuit is configured to output a reference image signal to the second driving circuit and to a first output pad in response to a power down signal, and wherein the second driving circuit is configured to output the received reference image signal to a second output pad.

The first driving circuit is connected to the second driving circuit via a signal line, a first switch is connected between the first driving circuit and the first output pad, and a second switch is connected between the second driving circuit and the second output pad.

Other features and aspects will be apparent from the following detailed description, the drawings, and the claims.

BRIEF DESCRIPTION OF THE DRAWINGS

FIG. 1 is a diagram illustrating an example of a display device in accordance with one or more embodiments.

FIG. 2 is a diagram illustrating an example of a display panel and a display driver in accordance with one or more embodiments.

FIG. 3 is a diagram illustrating an example of the display driver in accordance with one or more embodiments.

FIG. 4 is a diagram illustrating an example of the display driver in accordance with one or more embodiments.

FIG. 5 is a diagram illustrating an example of the display driver in accordance with one or more embodiments.

FIG. 6 is a diagram illustrating an example of the display device in accordance with one or more embodiments.

FIG. 7 is a diagram illustrating an example of the display driver in accordance with one or more embodiments.

FIG. 8 is a diagram illustrating an example of the display driver in accordance with one or more embodiments.

FIG. 9 is a diagram illustrating an example of the display driver in accordance with one or more embodiments.

FIG. 10 is a diagram illustrating an example of the display driver in accordance with one or more embodiments.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Unless otherwise defined, all terms, including technical and scientific terms, used herein have the same meaning as commonly understood by one of ordinary skill in the art to which this disclosure pertains after an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

FIG. 1 is a diagram illustrating an example of a display device in accordance with one or more embodiments. Referring to FIG. 1, a display device 10 may be an electronic circuit or a device for performing a function of displaying an image or a video. For example, the display device 10 may be a smartphone, a tablet personal computer, a mobile phone, a video phone, an e-book reader, a computer, a camera, or a wearable device, etc., but is not limited thereto.

The display device 10 includes a display driver 100, a timing controller 200, and a display panel 300. According to the example, at least one of the display driver 100, the timing controller 200, and the display panel 300 may be implemented as a one-chip.

The display driver 100 may control the display panel 300 under a control of the timing controller 200. According to the example, the display driver 100 may convert image data DATA transmitted from the timing controller 200 into analog image signals (e.g., gray-scale voltage), and may output the converted image signals into a plurality of channels CH_1 to CH_m (m is a natural number). The display driver 100 may output the image signal to the plurality of channels CH_1 to CH_m in units of rows.

The display driver 100 may be connected to the display panel 300 through the plurality of channels CH_1 to CH_m.

The timing controller 200 may receive video image data RGB from an external source, and may image-process the video image data RGB, or convert it into a format that is suitable for a structure of the display panel 300 to generate image data DATA. The timing controller 200 may transmit the image data DATA to the display driver 100.

The timing controller 200 may receive a plurality of control signals from an external host device. The control signals may include a horizontal synchronization signal (Hsync), a vertical synchronization signal (Vsync), and a clock signal (CLK).

The timing controller 200 may generate a control signal for controlling the display driver 100 based on the received control signals. According to the example, the timing controller 200 may generate a power down signal PD that may reduce the power consumption of the display driver, and may transmit the power down signal PD to the display driver 100. Herein, it is noted that use of the term 'may' with respect to an example or embodiment, e.g., as to what an example or embodiment may include or implement, means that at least one example or embodiment exists where such a feature is included or implemented while all examples and embodiments are not limited thereto.

The timing controller 200 may control the display driver 100 so that the display driver 100 provides the image signal to the plurality of channels CH_1 to CH_m based on the generated control signal.

The display panel 300 may include a plurality of sub-pixels PX arranged in rows and columns. For example, the display panel 300 may be implemented as examples one of a Light Emitting Diode (LED) display, an Organic LED (OLED) display, an Active Matrix OLED (AMOLED) display, an ElectroChromic Display (ECD), a Digital Mirror Device (DMD), an Actuated Mirror Device (AMD), a Grating Light Valve (GLV), a Plasma Display Panel (PDP), an Electro Luminescent Display (ELD), and a Vacuum Fluorescent Display (VFD), but is not limited thereto.

The sub-pixels PX arranged in the display panel 300 may be arranged in the column direction along the plurality of channels CH_1 to CH_m, and may be arranged in the row direction. At this time, a set of sub-pixels arranged in one column direction is referred to as a sub-pixel column.

The display panel 300 includes a plurality of horizontal lines, and one horizontal line is composed of the sub-pixels PX arranged in rows. During one horizontal time, the sub-pixels arranged in one horizontal line may be driven, and during a next horizontal time, the sub-pixels arranged in another horizontal line may be driven.

The sub-pixels PX may include a diode (e.g., a Light Emitting Diode (LED) or an Organic LED (OLED)) and a diode driving circuit for independently driving the diode. The diode driving circuit is connected to one row and one column, and the light emitting diode may be connected between the diode driving circuit and a power supply voltage (e.g., ground voltage).

The diode driving circuit may include a switching device, for example, a Thin Film Transistor (TFT). When the switching device is turned on, the diode driving circuit may supply the image signal received from the data lines connected to the diode driving circuit to the light emitting diode. Accordingly, the light emitting diode may output a light signal corresponding to the image signal.

Each of the sub pixels PX may be one of a red element R for outputting red light, a green element G for outputting green light, a blue element B for outputting blue light, and a white element W for outputting white light. The red element, the green element, and the blue element may be arranged in the display panel 300 in various methods. According to the examples, the sub-pixels PX of the display panel 300 may be repeatedly arranged in the order of R, G, B, G or B, G, R, G, etc., or may be repeatedly arranged in the order of R, G, B, W or B, W, R, G, etc. For example, the sub-pixels PX of the display panel 300 may be arranged according to an RGB stripe structure, an RGB pentile structure, or a RGBW structure, but are not limited thereto.

The respective configurations of the display device 10 may be implemented as a circuit or software that performs corresponding functions.

FIG. 2 is a diagram illustrating an example of a display panel and a display driver according to an example.

Referring to FIGS. 1 and 2, the sub-pixels PX of the display panel 300 may emit light by the image signals output from the display driver 100.

As the number of sub-pixels operating on the display panel 300 increases and a current (or voltage) flowing to the sub-pixels also increases, the power consumed by the display panel 300 or the display driver 100 increases. Therefore, in order to reduce the power consumption, it may be necessary to reduce the number of sub-pixels operating on the display panel 300, or to reduce a current flowing to the sub-pixels.

Referring to the display panel 300 illustrated in FIG. 2, the display panel 300 may include a general region N_REG, which is a region to be displayed in a normal mode, and a power down region PD_REG, which is a region to be displayed in a low power mode.

This may mean that the general region N_REG is a region that is displayed with the resolution (e.g., maximum resolution) supported by the display panel 300, and the power down region PD_REG is a region that is displayed with monochrome (e.g., black) or the resolution lower than the above resolution.

The sub-pixels of the general region N_REG may generally operate by receiving the image signal corresponding to the input image data, and the sub-pixels of the power down region PD_REG may operate or may be turned off by receiving a predetermined (fixed) image signal, which is different from the image signal corresponding to the input image data.

That is, it is possible to set a region, which does not generally need to operate in the general region N_REG of the display panel 300, as the power down region PD_REG to reduce the number of sub-pixels operating in the power down region PD_REG, or to reduce a current flowing to the sub-pixels, thus reducing the power consumption of the display panel 300 or the display driver 100. Meanwhile, the general region N_REG and the power down region PD_REG may be set according to a control of the display driver 100, and may be variable. For example, even in a region that has been set as the power down region PD_REG at a specific time point, that same region may be set as the general region N_REG at another time point.

The display driver according to the example may reduce the power consumption according to the driving of the sub-pixels of the power down region PD_REG.

FIG. 3 is a diagram illustrating an example of the display driver.

Referring to FIGS. 1 to 3, the display driver 100 may receive the image data (e.g., DATA in FIG. 1) through input pads IN_1 to IN_m, and may output the image signals to the display panel 300 through output pads SOUT_1 to SOUT_m.

The input pads IN_1 to IN_m and the output pads SOUT_1 to SOUT_m may be arranged in the display driver 100, but may also be arranged outside.

The display driver 100 may include a plurality of driving circuits DC_1 to DC_m and a gamma buffer 105.

Each of the plurality of driving circuits DC_1 to DC_m may be connected between each of the input pads IN_1 to IN_m and each of the output pads SOUT_1 to SOUT_m. According to the examples, the plurality of driving circuits DC_1 to DC_m may output the image signals corresponding to the image data input through the input pads IN_1 to IN_m through the output pads SOUT_1 to SOUT_m. That is, each of the plurality of driving circuits DC_1 to DC_m may drive the sub-pixels connected to the corresponding channels CH_1 to CH_m. For example, the first driving circuit DC_1 may drive the sub-pixels connected to the first channel CH_1.

The driving circuits DC_1 to DC_n (n is a natural number less than m) may drive the sub-pixels of the power down region PD_REG, and the driving circuits DC_n+1 to DC_m may drive the sub-pixels of the general region N_REG. Hereinafter, for convenience of explanation, the driving circuits DC_1 to DC_n for driving the power down region PD_REG are referred to as a first plurality of driving circuits DC_1 to DC_n, and the driving circuits DC_n+1 to DC_m for driving the general region N_REG are referred to as a second plurality of driving circuits DC_n+1 to DC_m. According to the examples, the first plurality of driving circuits DC_1 to DC_n may operate in a low power mode in response to the power down signal PD.

Each of the first plurality of driving circuits DC_1 to DC_m may include latches LATCH 110_1 to **110_*m*, level shifters LS 120_1 to 120_*m*, decoders DEC 130_1 to 130_*m*, and amplifiers AMP 140_1 to 140_*m*. According to the examples, each of the first plurality of driving circuits DC_1 to DC_n may include each of the switches SW_1 to SW_n, and the first driving circuit DC_1 may further include a data output unit 150_1**.

The latches 110_1 to **110_*m* may store pixel data therein. According to the embodiments, each of the latches 110_1 to 110_*m*** may store at least one of red pixel data R, green pixel data G, blue pixel data B, and white pixel data W.

The latches 110_1 to **110_*m* may receive the image data transmitted from the timing controller 200 through the input pads IN_1** to IN_m, and may store the received image data therein. According to the embodiments, the received image data may be data corresponding to light to be output by each of the sub-pixels PX.

The latches 110_1 to **110_*m* may output the stored image data. According to the examples, the remaining latches 110_2 to 110_*m* except for the first latch 110_1 may output the stored image data to the level shifters 120_2 to 120_*m* connected thereto, and the first latch 110_1 may output the stored image data (e.g., first image data) to the data output unit 150_1**.

The data output unit 150_1 included in the first driving circuit DC_1 may output any one of the first image data input from the first latch 110_1 and a reference image data in response to the power down signal PD. According to the examples, the data output unit 150_1 may output the first image data when the power down signal PD is disabled (e.g., when the power down signal PD is not present), and may output the reference image data when the power down signal PD is enabled.

The reference image data may be predetermined and stored in the data output unit 150_1. For example, the reference image data may be image data indicating black, i.e., "0", but is not limited thereto.

The level shifters (LS) 120_1 to **120_*m* may change (or interface) the level of the received image data (e.g., a voltage that becomes a reference of a logical value). According to the examples, the level shifters 120_1 to 120_*m* may collectively increase or collectively reduce the level of the received image data. For example, the level shifters 120_1 to 120_*m*** may change the received image data from a logic level "1" of the reference voltage 3.3V to a logic level "1" of the reference voltage 5V, but are not limited to the above numerical values.

Meanwhile, although it has been described in the present specification that the display driver 100 includes the level shifters 120_1 to **120_*m*, according to the examples, when there is a desire to change the level of the image data, the display driver 100 may not include the level shifters 120_1 to 120_*m***.

The decoders 130_1 to **130_*m* may output the gray-scale voltage corresponding to the input image data (e.g., the image data input from the latch or the image data converted by the level shifter) to the amplifiers 140_1 to 140_*m*. According to the examples, the decoders 130_1 to 130_*m* may receive the gray-scale voltage (e.g., R-gamma voltages, G-gamma voltages, and B-gamma voltages) corresponding to each of the image data input from the gamma buffer 105, and may output the gray-scale voltage corresponding to the input image data to the amplifiers 140_1 to 140_*m***.

The amplifiers 140_1 to **140_*m* may output as the image signals the gray-scale voltages (i.e., the gamma voltage corresponding to the image data) output from the decoders 130_1 to 130_*m* to the channels CH_1 to CH_m through the output pads SOUT_1 to SOUT_m. According to the examples, the amplifiers 140_1 to 140_*m* may convert (e.g., amplify) the gray-scale voltages output from the decoders 130_1 to 130_*m***, and may output the converted voltages as the image signals.

The amplifiers 140_1 to **140_*m* may operate in response to the power down signal PD. According to the examples, at least one amplifier of the amplifiers 140_1 to 140_*m* may be turned off in response to the power down signal PD. For example, the remaining amplifiers 140_2 to 140_*m* except for the first amplifier 140_1 among the amplifiers 140_1 to 140_*n* of the first plurality of driving circuits DC_1 to DC_n may be turned off in response to the power down signal PD, and the first amplifier 140_1 may output a reference image signal corresponding to the reference image data output from the data output unit 150_1** in response to the power down signal PD.

Meanwhile, although it has been illustrated in FIG. 3 that the amplifiers **140_*n*+1 to 140_*m* included in the second plurality of driving circuits DC_n+1 to DC_m may receive the power down signal PD, according to the examples, the amplifiers 140_*n*+1 to 140_*m*** may not receive the power down signal PD.

According to the examples, the first amplifier 140_1 of the amplifiers 140_1 to **140_*n* of the first plurality of driving circuits DC_1 to DC_n may be connected to the switches SW_1 to SW_n through a signal line LINE, but the remaining amplifiers 140_2 to 140_*n*** may not be directly connected to the signal line LINE.

Each of the switches SW_1 to SW_n may be connected to each of the output pads SOUT_1 to SOUT_n, and may be connected to the first driving circuit DC_1 through the signal line LINE. Meanwhile, each of the remaining switches SW_2 to SW_n except for the first switch SW_1 may not be directly connected to each of the corresponding amplifiers 140_1 to **140_*n***.

The switches SW_1 to SW_n may be turned on or turned off by the power down signal PD, and may output the signal transmitted from the signal line LINE to each of the output pads SOUT_1 to SOUT_n.

Meanwhile, although it has been illustrated in FIG. 3 that the first switch SW_1 is included in the first driving circuit DC_1, according to the examples, the first driving circuit DC_1 may not include the first switch SW_1. That is, the first amplifier 140_1 of the first driving circuit DC_1 may be directly connected to the first output pad SOUT_1.

FIG. 4 is a diagram illustrating an example of the display driver.

Referring to FIG. 4, it is assumed that the power down signal PD has been disabled (or has not been present). Referring to FIGS. 1 to 4, since the power down signal PD has been disabled, the display driver 100 and the display panel 300 may operate in a normal mode.

The latches 110_1 to **110_*m* output the input image data, and the data output unit 150_1 outputs first image data DATA1 transmitted from the first latch 110_1. Therefore, the decoders 130_1 to 130_*m* may output the gamma voltage corresponding to the image data (or the level-converted image data) input through the input pads IN_1 to IN_m to the amplifiers 140_1 to 140_*m***.

In this example, the amplifiers 140_1 to **140_*m* are all turned on, and may output image signals V_1 to V_m corresponding to the image data input through the input pads IN_1 to IN_m through the output pads SOUT_1 to SOUT_m using the gamma voltage output from the decoders 130_1 to 130_*m*. The switches SW_1** to SW_n may all be turned off.

Therefore, when the power down signal PD has been disabled, the general region N_REG and the power down region PD_REG may operate according to the normal mode.

FIG. 5 is a diagram illustrating the display driver according to the example. In FIG. 5, it is assumed that the power down signal PD has been enabled.

Referring to FIGS. 1 to 5, since the power down signal PD has been enabled, the display driver 100 and the display panel 300 operate in a low power mode.

Even if the power down signal PD is enabled, the driving circuits of the general region N_REG, that is, the second plurality of driving circuits DC_n+1 to DC_m may operate in the same manner as when the power down signal PD is disabled, such that only the operation of the first plurality of driving circuits DC_1 to DC_n will be described below.

The data output unit 150_1 outputs reference image data DATA_R instead of the first image data DATA1 in response to the power down signal PD. That is, when the power down signal PD is enabled, the first decoder 130_1 of the first driving circuit DC_1 outputs the gamma voltage corresponding to the reference image data DATA_R.

The remaining amplifiers 140_2 to **140_*n* except for the first amplifier 140_1 among the amplifiers 140_1 to 140_*n* included in the first plurality of driving circuits DC_1 to DC_n may all be turned off. The amplifiers 140_*n*+1** to 140_m included in the second plurality of driving circuits DC_n+1 to DC_m may all be turned on.

The turned-on first amplifier 140_1 may output a reference image signal V_R corresponding to the reference image data DATA_R using the gamma voltage output from the decoder 130_1. According to the example, the reference image signal V_R may indicate a non-zero certain value.

The reference image signal V_R output from the first amplifier 140_1 may be transmitted to the first output terminal SOUT_1 and may also be transmitted to each of the switches SW_1 to SW_n along the signal line LINE. The reference image signal V_R transmitted to each of the switches SW_1 to SW_n may be output through the output pads SOUT_2 to SOUT_n.

That is, when the power down signal PD is enabled, the first driving circuit DC_1 outputs the reference image signal V_R corresponding to the reference image data DATA_R, and the remaining driving circuits DC_2 to DC_n, except for the first driving circuit DC_1 among the first plurality of driving circuits DC_1 to DC_n, receive the reference image signal V_R output from the first driving circuit DC_1 via the signal line LINE, and output the received reference image signal V_R to each of the output pads SOUT_2 to SOUT_n.

Therefore, although the amplifiers 140_2 to **140_*n* of the remaining driving circuits DC_2 to DC_n, except for the first driving circuit DC_1 among the first plurality of driving circuits DC_1 to DC_n, are turned off in a low power mode, the first plurality of driving circuits DC_1 to DC_n may output the reference image signal V_R, in a same manner as if all of the amplifiers 140_1 to 140_*n* among the first plurality of driving circuits DC_1 to DC_n are turned on, thus consuming less power than when the reference image signal V_R is output through each of the individual amplifiers. However, since the reference image signal V_R is output to all of the output pads SOUT_1 to SOUT_n, the display panel 300 may be displayed in the same level as when the amplifiers 140_1 to 140_*n*** are all turned on to output the reference image signal V_R.

Meanwhile, although it has been described in the examples that the first driving circuit DC_1 includes the data output unit 150_1 and the reference image data DATA_R is output from the data output unit 150_1, according to the examples, the first driving circuit DC_1 may not include the data output unit 150_1. In this example, the reference image data DATA_R instead of the first image data DATA1 may be input to the first latch 110_1 in response to the power down signal PD.

FIG. 6 is a diagram illustrating an example of a display device.

Referring to FIG. 6, the display device 10 may be an electronic circuit or a device for displaying an image or a video. For example, the display device 10 may mean a smartphone, a tablet personal computer, a mobile phone, a video phone, an e-book reader, a computer, a camera, or a wearable device, etc., but is not limited thereto.

The display device 10 includes the display driver 100, the timing controller 200, and the display panel 300. According to the example, at least one of the display driver 100, the timing controller 200, and the display panel 300 may be implemented as a one-chip.

The display driver 100 may control the display panel 300 under the control of the timing controller 200. According to the example, the display driver 100 may convert the image data DATA transmitted from the timing controller 200 into analog image signals (e.g., gray-scale voltage), and may output the converted image signals into the plurality of channels CH_1 to CH_m (m is a natural number). The display driver 100 may output the image signal to the plurality of channels CH_1 to CH_m in units of rows.

The display driver 100 may be connected to the display panel 300 through the plurality of channels CH_1 to CH_m.

The timing controller 200 may receive video image data RGB from an external source, and may image-process the video image data RGB or convert it into a format that is suitable for a structure of the display panel 300 to generate the image data DATA. The timing controller 200 may transmit the image data DATA to the display driver 100.

The timing controller 200 may receive a plurality of control signals from an external host device. The control signals may include a horizontal synchronization signal (Hsync), a vertical synchronization signal (Vsync), and a clock signal (CLK).

The timing controller 200 may generate a control signal for controlling the display driver 100 based on the received control signals. According to the examples, the timing controller 200 may generate the power down signal PD which may reduce the power consumption of the display driver, and may transmit the power down signal PD to the display driver 100.

The timing controller 200 may control the display driver 100 so that the display driver 100 provides the image signal to the plurality of channels CH_1 to CH_m based on the generated control signal.

The display panel 300 may include the plurality of sub-pixels PX arranged in rows and columns. The display panel 300 of FIG. 6 may be substantially the same as the display panel 300 illustrated in FIG. 1. A description thereof will be omitted below.

FIG. 7 is a diagram illustrating an example of the display driver. Referring to FIGS. 6 and 7, the display driver 100 may receive the image data through the input pads IN_1 to IN_m, and may output the image signals to the display panel 300 through the output pads SOUT_1 to SOUT_m.

The display driver 100 may include the plurality of driving circuits DC_1 to DC_m and the gamma buffer 105.

Each of the plurality of driving circuits DC_1 to DC_m may be connected between each of the input pads IN_1 to IN_m and each of the output pads SOUT_1 to SOUT_m. According to the examples, the plurality of driving circuits DC_1 to DC_m may output the image signals corresponding to the image data input through the input pads IN_1 to IN_m through the output pads SOUT_1 to SOUT_m. That is, each of the plurality of driving circuits DC_1 to DC_m may drive the sub-pixels connected to the corresponding channels CH_1 to CH_m. For example, the first driving circuit DC_1 may drive the sub-pixels connected to the first channel CH_1.

The driving circuits DC_1 to DC_m may be turned off based on the power down signal PD.

Each of the driving circuits DC_1 to DC_m may include the latches LATCH 110_1 to **110_*m*, the level shifters LS 120_1 to 120_*m*, the decoders DEC 130_1 to 130_*m*, the amplifiers AMP 140_1 to 140_*m*, multiplexers MUX 160-1 to 160-*m*, and switches SW_1 to SW_m. According to the examples, the first driving circuit DC_1 and the re driving circuit may further include the data output units 150_1 and 150_*m***.

The latches 110_1 to **110_*m* may receive the image data transmitted from the timing controller 200 through the input pads IN_1** to IN_m, and may store the received image data. According to the examples, the received image data may be data corresponding to light to be output by each of the sub-pixels PX.

The latches 110_1 to **110_*m* may output the stored image data. According to the examples, the remaining latches 110_2 to 110_*m* except for the first latch 110_1 may output the stored image data to the level shifters 120_2 to 120_*m* connected thereto, the first latch 110_1 may output the stored image data (e.g., first image data) to the first data output unit 150_1, and the $m^{th}$ latch 110_*m* may output the stored image data (e.g., first image data) to the $m^{th}$ data output unit 150_*m***.

The data output units 150_1 and **150_*m* may output one of the image data input from the latches 110_1 and 110_*m* and the reference image data in response to the power down signal PD. For example, the first data output unit 150_1 may output the first reference image data when the power down signal PD is enabled, and may output the first image data input from the first latch 110_1 when the power down signal PD is disabled. The $m^{th}$ data output unit 150_*m*** may also operate in this manner.

The first reference image data and the $m^{th}$ reference image data may be predetermined and stored in each of the data output units 150_1 and **150_*m***, and the first reference image data and the $m^{th}$ reference image data may be different from each other, but are not limited thereto. For example, the first reference image data may be image data indicating white, that is, "1," and the $m^{th}$ reference image data may be image data indicating black, that is, "0," but the reference image data is not limited thereto.

The level shifters 120_1 to **120_*m* may change (or interface) the level of the received image data (e.g., a voltage that becomes a reference of a logical value). According to the examples, the level shifters 120_1 to 120_*m* may collectively increase or collectively reduce the level of the received image data. For example, the level shifters 120_1 to 120_*m*** may change the received image data from the logic level "1" of the reference voltage 3.3V to the logic level "1" of the reference voltage 5V, but are not limited to the numerical values.

Meanwhile, although it has been described in the examples that the display driver 100 may include the level shifters 120_1 to **120_*m*, according to the examples, when there is a desire to change the level of the image data, the display driver 100 may not include the level shifters 120_1 to 120_*m***.

The decoders 130_1 to **130_*m* may output the gray-scale voltage corresponding to the input image data (e.g., the image data input from the latch or the image data converted by the level shifter) to the amplifiers 140_1 to 140_*m*. According to the examples, the decoders 130_1 to 130_*m* may receive the gray-scale voltage (e.g., R-gamma voltages, G-gamma voltages, and B-gamma voltages) corresponding to each of the image data input from the gamma buffer 105, and may output the gray-scale voltage corresponding to the input image data to the amplifiers 140_1 to 140_*m***.

The amplifiers 140_1 to **140_*m* may output as the image signals the gray-scale voltages (i.e., the gamma voltage corresponding to the image data) output from the decoders 130_1 to 130_*m* to the channels CH_1 to CH_m through the output pads SOUT_1 to SOUT_m. According to the examples, the amplifiers 140_1 to 140_*m* may convert (e.g., amplify) the gray-scale voltages output from the decoders 130_1 to 130_*m***, and may output the converted voltages as the image signals.

The amplifiers 140_1 to **140_*m* may operate in response to the power down signal PD. According to the examples, at least one amplifier of the amplifiers 140_1 to 140_*m* may be turned off in response to a receipt of the power down signal PD. For example, the remaining amplifiers 140_2 to 140_*m*−1 except for the first amplifier 140_1 and the $m^{th}$ amplifier 140_*m* may be turned off in response to a receipt of the power down signal PD, and the first amplifier 140_1 and the $m^{th}$ amplifier 140_*m* may output the reference image signals corresponding to the reference image data output from the data output units 150_1 and 150_*m*** in response to the power down signal PD.

The multiplexers 160_1 to **160_*m* may select any one of the image signal transmitted along the first signal line L1 and the image signal transmitted along the second signal line L2 based on the selection signals SEL_1 to SEL_m, and may output one selected image signal to the switches SW_1 to SW_m. According to the example, the multiplexers 160_1 to 160_*m* may be composed of at least one switch. Although FIG. 7 illustrates that the multiplexers may select image signals from a first signal line L1 and a second signal line L2**, the number of signal lines is only an example, and a number of signal lines greater than two may be implemented.

The multiplexers 160_1 to **160_*m* may be connected to each other through the signal lines L1 and L2. According to the example, the multiplexers 160_1 to 160_*m* may be connected to the first driving circuit DC_1 through a first connection node C1, and may be connected to the re driving circuit DC_m through a second connection node C2. However, the multiplexers 160_1 to 160_*m* may not be directly connected to the remaining driving circuits DC_2 to DC_m−1. That is, the multiplexers 160_1 to 160_*m* may not receive the image signals output from the remaining driving circuits DC_2** to DC_m−1.

The selection signals SEL_1 to SEL_m may be determined based on the image data input through the input pads IN_1 to IN_m. According to the example, the selection signals SEL_1 to SEL_m may be set based on each bit of the image data input through the input pads IN_1 to IN_m. For example, the selection signals SEL_1 to SEL_m may be set based on a most significant bit (MSB) of the input image data.

That is, the multiplexers 160_1 to **160_*m* may perform the selection operation based on the image data input through the input pads IN_1** to IN_m. For example, when the MSB of the input image data is "1," the multiplexer may output the first reference image signal, and when the MSB of the input image data is "0," the multiplexer may output the second reference image signal.

The selection signals SEL_1 to SEL_m may be determined based on the input image data, and may be transmitted from the decoders 130_1 to **130_*m* or the level shifters 120_1 to 120_*m***.

Although it has been illustrated in FIG. 7 that the multiplexers 160_1 to **160_*m* may receive two inputs, according to the examples, the multiplexers 160_1 to 160_*m* may receive an arbitrary number of inputs. For example, the multiplexers 160_1 to 160_*m*** may receive $2^k$ inputs (k is a natural number).

The switches SW_1 to SW_m may be connected to the output pads SOUT_1 to SOUT_m. The switches SW_1 to SW_m may output any one of the image signal output from the multiplexers 160_1 to **160_*m* and the image signal output from the amplifiers 140_1 to 140_*m* to the output pads SOUT_1** to SOUT_m based on the power down signal PD.

For example, the switches SW_1 to SW_m may include a first switch element connected between the output pads SOUT_1 to SOUT_m and the multiplexers 160_1 to **160_*m* and a second switch element connected between the output pads SOUT_1 to SOUT_m and the amplifiers 140_1 to 140_*m***.

FIG. 8 is a diagram illustrating an example of the display driver. In FIG. 8, it is assumed that the power down signal PD has been disabled (or has been not present).

Referring to FIGS. 6 to 8, since the power down signal PD has been disabled, the data output units 150_1 and **150_*m* may output the image data transmitted from the latches 110_1 and 110_*m*. Therefore, the decoders 130_1 to 130_*m* may output the gamma voltage corresponding to the image data (or the level-converted image data) input through the input pads IN_1 to IN_m to the amplifiers 140_1 to 140_*m***.

The amplifiers 140_1 to **140_*m* may all be turned on, and may output the image signals V_1 to V_m corresponding to the image data input through the input pads IN_1 to IN_m using the gamma voltage output from the decoders 130_1 to 130_*m***.

The switches SW_1 to SW_m may output the image signals V_1 to V_m output from the amplifiers 140_1 to **140_*m* through the output pads SOUT_1** to SOUT_m based on the disabled power down signal PD.

Therefore, when the power down signal PD has been disabled, the amplifiers 140_1 to **140_*m* may all be turned on, and the image signals V_1 to V_m output from the amplifiers 140_1 to 140_*m* and corresponding to the input image data may be output through the output pads SOUT_1** to SOUT_m.

FIG. 9 is a diagram illustrating an example of the display driver. In FIG. 9, it is assumed that the power down signal PD has been enabled.

Referring to FIGS. 6 to 9, the first data output unit 150_1 may output the first reference image data DATA_R1 instead of the first image data output from the first latch 110_1 in response to the power down signal PD, and the re data output unit **150_*m* may output the $m^{th}$ reference image data DATA_Rm instead of the $m^{th}$ image data output from the re latch 110_*m*** in response to the power down signal PD.

Therefore, when the power down signal PD is enabled, the first decoder 130_1 of the first driving circuit DC_1 outputs the gamma voltage corresponding to the first reference image data DATA_R1, and the $m^{th}$ decoder **130_*m*** of the $m^{th}$ driving circuit DC_m outputs the gamma voltage corresponding to the $m^{th}$ reference image data DATA_Rm.

When the power down signal PD is enabled, the remaining amplifiers 140_2 to **140_*m*−1 except for the first amplifier 140_1 and the $m^{th}$ amplifier 140_*m* are all turned off. The turned-on first amplifier 140_1 may output the first reference image signal V_R1 corresponding to the first reference image data DATA_R1 using the gamma voltage output from the first decoder 130_1. The turned-on $m^{th}$ amplifier 140_*m* may output the $m^{th}$ reference image signal V_Rm corresponding to the $m^{th}$ reference image data DATA_Rm using the gamma voltage output from the $m^{th}$ decoder 130_*m***.

According to the examples, the reference image signals V_R1 and V_Rm may indicate a non-zero certain value.

The first reference image signal V_R1 output from the first amplifier 140_1 may be transmitted to the multiplexers 160_1 to **160_*m* along the first signal line L1 through the first connecting node C1, and the $m^{th}$ reference image signal V_Rm output from the $m^{th}$ amplifier 140_*m* may be transmitted to the multiplexers 160_1 to 160_*m* along the second signal line L2 through the second connecting node C2**.

The multiplexers 160_1 to **160_*m* may output any one of the selection signals SEL_1 to SEL_m and the first reference image signal V_R1 and the $m^{th}$ reference image signal V_Rm transmitted through the signal lines L1 and L2 to the switches SW_1 to SW_m. That is, the multiplexers 160_1 to 160_*m* may use the first reference image signal V_R1 output from the first amplifier 140_1 and the $m^{th}$ reference image signal V_Rm output from the $m^{th}$ amplifier 140_*m*** as reference values.

As described above, the selection signals SEL_1 to SEL_m may be the MSB of the image data (or the image data converted by the level shifter).

The switches SW_1 to SW_m may output any one reference image signal selected from the multiplexers 160_1 to **160_*m* to the output pads SOUT_1** to SOUT_m in response to the enabled power down signal PD.

That is, when the power down signal PD is enabled, the first driving circuit DC_1 and the $m^{th}$ driving circuit DC_m may output the reference image signals V_R1 and V_Rm corresponding to the reference image data DATA_R1 and DATA_Rm, and the remaining driving circuits DC_2 to DC_m−1 among the driving circuits DC_1 to DC_m may receive the reference image signals V_R1 and V_Rm output from the first driving circuit DC_1 and the $m^{th}$ driving circuit DC_m via the respective multiplexers 160_2 to **160_*m*−1, and may output the received reference image signals V_R1 and V_Rm to each of the output pads SOUT_2** to SOUT_m−1.

Therefore, although the amplifiers 140_2 to **140_*m*−1 of the remaining driving circuits DC_2 to DC_m−1, except for the first driving circuit DC_1 and the $m^{th}$ driving circuit DC_m among the driving circuits DC_1 to DC_m, are turned off, all of the driving circuits DC_1 to DC_m may output the reference image signals V_R1 and V_Rm, in a same manner as if all of the amplifiers 140_1 to 140_*m* of the driving circuits DC_1 to DC_m are turned on, thus consuming less power than when the reference image signals V_R1** and V_Rm are output through each of the individual amplifiers.

However, since the reference image signals V_R1 and V_Rm are output to all of the output pads SOUT_1 to SOUT_m, the display panel 300 may be displayed at the same level as when all of the amplifiers 140_1 to **140_*m* are turned on to output the reference image signals V_R1** and V_Rm.

Additionally, in the typical monochromatic mode, a separate circuit for supplying the gamma voltage corresponding to the reference image signal may have to be provided in the display driver, and the signal lines for the supply may be needed, therefore resulting in a problem that the size of the display driver is increased. However, since the display driver according to the example implements the existing amplifiers, the monochromatic mode may be implemented without increasing the size of the display driver.

Additionally, although the driving circuits DC_1 and DC_m may include the data output units 150_1 and **150_*m* and the reference image data DATA_R1 and DATA_Rm may be output from the data output units 150_1 and 150_*m*, in an example, the driving circuits DC_1 and DC_m may not include the data output units 150_1 and 150_*m*. In this example, the reference image data DATA_R1 and DATA_Rm may be input to the latches 110_1 and 110_*m*** in response to the power down signal PD, instead of the image data.

According to FIG. 9, although it has been illustrated that two driving circuits DC_1 and DC_m include the data output units 150_1 and **150_*m*, two amplifiers 140_1 and 140_*m* output the reference image signals V_R1 and V_Rm in response to the power down signal PD, the remaining amplifiers 140_2 to 140_*m*−1 are turned off, and the multiplexers 160_1 to 160_*m* receive the two reference image signals V_R1 and V_Rm through the two signal lines L1 and L2**, the examples are not limited thereto.

According to the examples, in the display driver, $2^k$ (k is a natural number) driving circuits may include data output units, and $2^k$ amplifiers may not be turned off in response to the power down signals to output $2^k$ reference image signals, and the multiplexers may receive the $2^k$ reference image signals through $2^k$ signal lines. That is, the examples may use the $2^k$ reference image signals.

FIG. 10 illustrates an example when k=2.

The power down signal PD of FIG. 10 may include at least one of a first power down signal PD1 and a second power down signal PD2. According to the example, when the first power down signal PD1 is enabled, the second amplifier 140_2, the third amplifier 140_3, and the fifth amplifier 140_5 are turned off, and when the second power down signal PD2 is enabled, the fifth amplifier 140_5 is turned off. That is, the first power down signal PD1 may enable the first amplifier 140_1 and the fourth amplifier 140_4, and the second power down signal PD2 may enable the first to fourth amplifiers 140_1 to 140_4.

Hereinafter, it is assumed that the second power down signal PD2 has been enabled.

FIG. 10 is a diagram illustrating an example of the display driver.

Referring to FIG. 10, the first to fourth driving circuits DC_1 to DC_4 include the data output units 150_1 to 150_4, and the fifth driving circuit DC_5 does not include the data output unit.

When the power down signal PD is enabled, the data output units 150_1 to 150_4 may output the corresponding reference image data. For example, the data output units 150_1 to 150_4 may output four types of reference image data.

The fifth amplifier 140_5 may be turned off, and the turned-on amplifiers 140_1 to 140_4 may output the reference image signals corresponding to the reference image data using the gamma voltage output from the decoders 130_1 to 130_4.

Accordingly, the first reference image signal output from the first amplifier 140_1 may be transmitted to the multiplexers 160_1 to 160_5 along the first signal line L1 through the first connection node C1, the second reference image signal output from the second amplifier 140_2 may be transmitted to the multiplexers 160_1 to 160_5 along the second signal line L2 through the second connection node C2, the third reference image signal output from the third amplifier 140_3 may be transmitted to the multiplexers 160_1 to 160_5 along a third signal line L3 through a third connection node C3, and the fourth reference image signal output from the fourth amplifier 140_4 may be transmitted to the multiplexers 160_1 to 160_5 along a fourth signal line L4 through a fourth connection node C4.

The multiplexers 160_1 to 160_5 may output any one of the selection signals SEL_1 to SEL_5 and the reference image signals transmitted through the signal lines L1 to L4 to the switches SW_1 to SW_5. That is, the multiplexers 160_1 to 160_5 may use the first to fourth reference image signals output from the amplifiers 140_1 to 140_4 as reference values.

According to the examples, the selection signals SEL_1 to SEL_5 may be composed of the MSB of the image data (or the image data converted by the level shifter) and the next bit thereof, and accordingly, may have four values.

The switches SW_1 to SW_5 may output any one reference image signal selected from the multiplexers 160_1 to 160_5 to the output pads SOUT_1 to SOUT_5 in response to the switching signal SW. According to the examples, the switching signal SW may include the power down signals PD1 and PD2.

That is, the first to fourth driving circuits DC_1 to DC_4 may output the reference image signals corresponding to the reference image data, and the fifth driving circuit DC_5 including the fifth amplifier 140_5 turned off in response to the power down signal PD may receive the reference image signals output from the driving circuits DC_1 to DC_4, and may output the received reference image signals to the output pad SOUT_5.

Although it has been illustrated in FIG. 10 that only one amplifier 140_5 may be turned off in response to the power down signal PD, this is only an example, and a plurality of amplifiers may be turned off in response to the power down signal PD.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A display driver comprising:

a first driving circuit comprising a first amplifier and configured to output a first image signal corresponding to first image data to a first output pad;

a second driving circuit comprising a second amplifier and configured to output a second image signal corresponding to second image data to a second output pad; and a third driving circuit comprising a third amplifier and configured to output a third image signal corresponding to third image data to a third output pad, wherein the first driving circuit is further configured to output a first reference image signal corresponding to first reference image data to the first output pad, the second driving circuit, and the third driving circuit in response to a power down signal, wherein the second driving circuit is further configured to output a second reference image signal corresponding to second reference image data to the second output pad, the first driving circuit, and the third driving circuit in response to the power down signal, wherein the first amplifier and the second amplifier each are configured to be turned on to output the first and second reference image signals, respectively, and the third amplifier is configured to be turned off, in response to the power down signal, and wherein the third driving circuit is further configured to output any one of the first reference image signal and the second reference image signal in response to the power down signal.

2. The display driver of claim 1, wherein the first driving circuit comprising the first amplifier is configured to output one of the first image signal and the first reference image signal, and wherein the second driving circuit comprising the second amplifier is configured to output one of the second image signal and the second reference image signal.

3. The display driver of claim 2, wherein the third driving circuit further comprises a multiplexer configured to select any one of the first reference image signal output from the first driving circuit and the second reference image signal output from the second driving circuit, and further configured to output the selected image signal, and wherein the multiplexer is further configured to perform the selecting based on a most significant bit (MSB) of the third image data.

4. The display driver of claim 3, wherein the multiplexer is connected to the first driving circuit through a first signal line and is connected to the second driving circuit through a second signal line, and wherein the third image signal output from the third driving circuit is not transmitted to the multiplexer.

5. The display driver of claim 1, wherein the first driving circuit comprises:

a first latch configured to store the first image data; and a first data output unit configured to output one of the first image data output from the first latch and the stored first reference image data, wherein the second driving circuit comprises:

a second latch configured to store the second image data; and a second data output unit configured to output one of the second image data output from the second latch and the stored second reference image data, wherein the first data output unit is further configured to output the first reference image data instead of the first image data in response to the power down signal, and wherein the second data output unit is further configured to output the second reference image data instead of the second image data in response to the power down signal.

6. The display driver of claim 5, wherein the first data output unit and the second data output unit are implemented as a set of logic gates comprising at least one of an OR gate and a NOR gate.

7. A display driver comprising:

a first driving circuit comprising a first amplifier and configured to output a first image signal to a first output pad; and a second driving circuit comprising a second amplifier and configured to output a second image signal to a second output pad, wherein the first driving circuit is further configured to output a reference image signal to the first output pad and the second driving circuit, in response to a power down signal, wherein the first amplifier is configured to be turned on to output the reference image signal to the first output pad and the second amplifier is configured to be turned off, in response to the power down signal, and wherein the second driving circuit is further configured to output the reference image signal received from the first amplifier to the second output pad in response to the power down signal.

8. The display driver of claim 7, wherein the second driving circuit comprises a switch connected between the second output pad and the first driving circuit, and wherein the switch is configured to output the reference image signal output from the first driving circuit to the second output pad in response to the power down signal.

9. The display driver of claim 8, wherein the first driving circuit comprising the first amplifier is configured to output one of the first image signal and the reference image signal.

10. The display driver of claim 8, wherein the display driver further comprises a signal line connected between the first driving circuit and the switch of the second driving circuit.

11. The display driver of claim 7, wherein the first driving circuit comprises:

a first latch configured to store first image data corresponding to the first image signal; and a data output unit configured to output one of the first image data output from the first latch and reference image data corresponding to the reference image signal, and wherein the data output unit is further configured to output the reference image data instead of the first image data in response to the power down signal.

12. The display driver of claim 11, wherein the data output unit is implemented as a set of logic gates comprising at least one of an OR gate and a NOR gate.

13. The display driver of claim 7, wherein the first image signal is generated based on first image data input from a first input pad, wherein the second image signal is generated based on second image data input from a second input pad, and wherein the reference image signal is generated based on reference image data previously stored in the display driver.

14. A display driver comprising:

a first driving circuit comprising a first amplifier and connected to a first sub-pixel column among a plurality of sub-pixel columns; and a second driving circuit comprising a second amplifier and connected to a second sub-pixel column among the plurality of sub-pixel columns, wherein the first driving circuit is configured to output a first image signal to the first sub-pixel column when the display driver operates in a first mode, and is further configured to output a reference image signal to a first output pad of the first driving circuit and the second driving circuit when the display driver operates in a second mode, wherein the second driving circuit is configured to output a second image signal to the second sub-pixel column when the display driver operates in the first mode, and is further configured to output the reference image signal received from the first amplifier to the second sub-pixel column when the display driver operates in the second mode, wherein the first amplifier is configured to be turned on to output the reference image signal and the second amplifier is configured to be turned off, in response to the display driver operating in the second mode, and wherein the power consumed by the display driver in the first mode is greater than the power consumed by the display driver in the second mode.

15. The display driver of claim 14, wherein the display driver is configured to operate in the second mode in response to a power down signal, wherein the first driving circuit is further configured to output the reference image signal to the second driving circuit in response to the power down signal, and wherein the second driving circuit is further configured to output the reference image signal output from the first driving circuit to the second sub-pixel column in response to the power down signal.

16. The display driver of claim 15, wherein the first driving circuit comprising the first amplifier is configured to output one of the first image signal and the reference image signal.

17. The display driver of claim 15, wherein the first driving circuit comprises:

a first latch configured to store first image data corresponding to the first image signal; and a data output unit configured to output one of the first image data output from the first latch and reference image data corresponding to the reference image signal, and wherein the data output unit is further configured to output the reference image data instead of the first image data in response to the power down signal.

18. The display driver of claim 17, wherein the data output unit is implemented as a set of logic gates comprising at least one of an OR gate and a NOR gate.

19. A display device comprising a display panel and a display driving device, the display device comprising:

a plurality of driving circuits;

wherein the display driving device is configured to operate in a normal mode and a power down mode;

wherein, in the power down mode, a first amplifier of a first driving circuit of the plurality of driving circuits is configured to be turned on to output a reference image signal, and a second amplifier of a second driving circuit of the plurality of driving circuits is configured to be turned off, in response to a power down signal;

wherein, in the power down mode, the first driving circuit is configured to output the reference image signal to the second driving circuit and to a first output pad in response to the power down signal, and wherein the second driving circuit is configured to output the reference image signal received from the first amplifier to a second output pad in response to the power down signal.

20. The display device of claim 19, wherein the first driving circuit is connected to the second driving circuit via a signal line, a first switch is connected between the first driving circuit and the first output pad, and a second switch is connected between the second driving circuit and the second output pad.

21. A display driver, comprising:

a first driving circuit comprising a first amplifier and configured to output a first image signal to a first output pad; and a plurality of driving circuits comprising second to nth amplifiers and configured to output second to nth image signals to second to nth output pads, respectively, n being a positive integer greater than 2, wherein the first driving circuit is further configured to output a reference image signal to the first output pad and the plurality of driving circuits in response to a power down signal, wherein the first amplifier is configured to be turned on to output the reference image signal and the second to nth amplifiers are configured to be turned off, in response to the power down signal, and wherein the plurality of driving circuits are further configured to output the reference image signal received from the first amplifier to the second to nth output pads in response to the power down signal.

22. The display driver of claim 21, wherein each of the plurality of driving circuits comprises a switch connected between a corresponding output pad and the first driving circuit, and wherein the switch is configured to output the reference image signal output from the first driving circuit to the corresponding output pad in response to the power down signal.

23. The display driver of claim 22, wherein the first driving circuit comprising the first amplifier is configured to output one of the first image signal and the reference image signal.

* * * * *